US006206755B1

(12) United States Patent
Samsel

(10) Patent No.: US 6,206,755 B1
(45) Date of Patent: Mar. 27, 2001

(54) METHOD AND APPARATUS FOR MAKING BLUNT NEEDLES

(75) Inventor: W. Scott Samsel, Bristol, CT (US)

(73) Assignee: United States Surgical Corporation, Norwalk, CT (US)

( * ) Notice: Subject to any disclaimer, the term of this patent is extended or adjusted under 35 U.S.C. 154(b) by 0 days.

(21) Appl. No.: 08/325,847

(22) Filed: Oct. 19, 1994

(51) Int. Cl.[7] ..... B24B 7/30

(52) U.S. Cl. ..... 451/28; 451/35

(58) Field of Search ..... 451/32, 33, 34, 451/35, 326, 327, 328, 329, 330

(56) References Cited

U.S. PATENT DOCUMENTS

| | | | | |
|---|---|---|---|---|
| 389,552 | | 9/1888 | Dean et al. . | |
| 722,105 | | 3/1903 | Harvey . | |
| 957,999 | | 5/1910 | Parsons . | |
| 1,352,598 | | 9/1920 | Hart . | |
| 1,678,359 | * | 7/1928 | Schulte | 451/35 |
| 1,750,499 | | 3/1930 | Truax . | |
| 2,062,671 | | 12/1936 | Lupo . | |
| 2,174,880 | | 10/1939 | Hilbish et al. . | |
| 2,185,262 | | 1/1940 | Lupo, Jr. . | |
| 2,318,578 | | 5/1943 | Balz et al. . | |
| 2,318,579 | | 5/1943 | Balz et al. . | |
| 2,318,580 | | 5/1943 | Balz et al. . | |
| 2,435,488 | | 2/1948 | Baylin . | |
| 2,439,156 | | 4/1948 | Castle . | |
| 2,440,656 | | 4/1948 | Huntington . | |
| 2,683,343 | * | 7/1954 | Gillette et al. | 451/34 |
| 2,806,334 | * | 9/1957 | Oshry et al. | 451/35 |
| 2,978,850 | | 4/1961 | Gleszer . | |
| 2,994,165 | | 8/1961 | Brevik . | |
| 3,022,017 | | 2/1962 | McKenna . | |
| 3,100,088 | | 8/1963 | Podmore et al. . | |
| 3,230,671 | | 1/1966 | Rampe . | |
| 3,239,970 | | 3/1966 | Bishop . | |
| 3,394,704 | | 7/1968 | Dery . | |
| 3,453,782 | | 7/1969 | Hageloken et al. . | |
| 3,589,428 | | 6/1971 | Masujima . | |
| 3,613,317 | * | 10/1971 | Kittredge et al. | 451/330 |
| 3,680,266 | | 8/1972 | Shiplov . | |
| 3,788,119 | | 1/1974 | Arrigo . | |
| 3,997,358 | | 12/1976 | Taylor . | |
| 3,998,259 | | 12/1976 | Zocher . | |
| 4,044,814 | | 8/1977 | Zocher . | |
| 4,054,144 | | 10/1977 | Hoffman et al. . | |
| 4,072,041 | | 2/1978 | Hoffman et al. . | |
| 4,127,219 | | 11/1978 | Mabus . | |
| 4,258,505 | | 3/1981 | Scheiber et al. . | |
| 4,430,358 | | 2/1984 | Wada . | |
| 4,455,858 | | 6/1984 | Hettich . | |
| 4,524,815 | | 6/1985 | Pavel et al. . | |
| 4,541,470 | | 9/1985 | Pavel . | |
| 4,548,251 | | 10/1985 | Lange . | |
| 4,561,445 | | 12/1985 | Berke et al. . | |
| 4,785,868 | | 11/1988 | Koenig, Jr. . | |
| 4,978,259 | | 12/1990 | Wollam . | |
| 5,042,558 | | 8/1991 | Hussey et al. . | |
| 5,123,910 | | 6/1992 | McIntosh . | |
| 5,139,514 | | 8/1992 | Korthoff et al. . | |
| 5,140,783 | | 8/1992 | Hoffman . | |
| 5,342,397 | | 8/1994 | Guido . | |
| 5,383,901 | | 1/1995 | McGregor et al. | 606/223 |
| 5,447,465 | * | 9/1995 | Samsel et al. | 451/32 |
| 5,477,604 | * | 12/1995 | Smith et al. | 451/244 |
| 5,601,475 | * | 2/1997 | Stametz et al. . | |

OTHER PUBLICATIONS

Oakite Material Safety Data Sheet (Oct. 25, 1990).

"Ceramic Media", Vibra Finish Co.

"Fine Diastone", Nippon DIa Industry Co.

"TV–10", Raytech Industries Inc.

Dreher, Centrifugal Tumbling Machine FT 4/10 VG, Dreher Corporation.

Dreher "Precision Sliding Grinding in Centrifugal Equipment" Industrial and Production Engineering (1985).

Abraham Jr., "Steel Media and its Finishing Applications" Mechanical Finishing.

Suize, "Drilled End Surgical Needles", (Oct. 1986).

* cited by examiner

*Primary Examiner*—Joseph J. Hail, III
*Assistant Examiner*—Daniel Shanley

(57) ABSTRACT

A method for forming blunt surgical needles having a radiused tip includes tumbling the surgical needles in a tumbling medium for a period of time sufficient to achieve a desired radius on the tip of the needle. The needles to be radiused may be taper pointed needles, taper pointed needles with a portion of the tip removed, or partially completed tapered needles. Tumbling may be performed in one or more tumbling steps using abrasive and/or burnishing media If an abrasive tumbling operation is used, preferably a second tumbling operation is performed with a hard, smooth medium which burnishes rather than abrades the needle. The tumbling media used to form a radius on the needle tip preferably is wet and can be acidic, neutral, or alkaline. The radiused needles may be polished by subsequent tumbling in a substantially dry tumbling medium.

26 Claims, No Drawings

METHOD AND APPARATUS FOR MAKING BLUNT NEEDLES

BACKGROUND

1. Technical Field

The method and apparatus herein described relate to the manufacture of surgical needles.

2. Background of the Art

Surgical needles are known in the art. Typically, a surgical needle has a barrel end to which a suture is attached, and a tapered end which terminates in a sharp tissue piercing point. Optionally, the needle may be ground and polished to have cutting edges as well as a sharp point.

In some applications it may be desirable to have a blunt needle without a sharp point or cutting edges. Blunt needles can have a tapered or non-tapered tissue piercing tip which is capable of penetrating delicate organs, such as the liver, or soft tissue, such as muscle, fascia, adipose, etc. An advantage of a blunt needle is that the needle does not cut friable tissue such as the liver, and may reduce the likelihood the needle may penetrate cutaneous tissue, (such as the skin of the surgeon's hand) under operating conditions where the needle is not under the surgeon's direct vision. Thus, the tip of the blunt surgical needle is adequate for certain surgical procedures performed inside the human or animal body, while protecting friable tissue and offering the surgeon a degree of safety from inadvertent needle stabs.

Ball point blunt needles and tapered blunt tip needles and their use have been known for many years. In the past blunt needles typically have been made by machining or grinding tapered needles to form a radiused blunt tip. Such a method is expensive, time consuming, and not conducive to economically producing large quantities of blunt needles at one time.

SUMMARY

A method is provided herein for producing blunt surgical needles having a radiused tip from finished or semi-finished tapered surgical needles. The blunt needles made by the method disclosed herein may be ball point or blunt taper point or blunt pointed needles of other configurations, as desired. The method comprises forming a radius at the tip of the surgical needle by a first tumbling operation in a tumbler with a first medium for a first duration of tumbling time. Optionally, the tip of the needle may be cut or ground off of the needle prior to tumbling to produce an even broader blunt tip. As yet a further alternative, the starting needle may be partially formed without completing the needle tip, such as a needle which has been tapered but the final tip configuration has not been completed. Removing a portion of the tip prior to tumbling, or starting with an incompletely formed tip, may reduce the tumbling time required to achieve the desired result. The method may include an abrasive tumbling step alone or in combination with a burnishing step. Alternatively, a burnishing tumbling step alone may be used to form a radius on the tip of the needle. In either case, burnishing preferably is performed using a hard medium such as porcelain balls. Also, an optional polishing step may be performed by tumbling with a substantially dry soft medium such as, for example, dry walnut shells, cob meal, wood pegs, etc. Tumbling may be performed in vibratory, rotary or centrifugal type tumblers. Hard media such as steel, porcelain, aluminum oxide, etc. normally are wet to aid in removal of fines, aid lubricity, and soften the tumbling process. Wet tumbling compounds may be acidic or alkaline. Various other components, such as silica or lime, may be added to the medium.

DETAILED DESCRIPTION OF PREFERRED EMBODIMENT(S)

The method and apparatus described herein are directed to forming a radiused tip and blunting the sharp edges of surgical needles by a tumbling operation. Tumbling is described in copending U.S. application Ser. No. 08/091,545, now issued as U.S. Pat. No. 5,447,465 which is hereby incorporated by reference in its entirety.

The needles to be treated by the tumbling operation described herein may be fabricated from any material suitable for the manufacture of surgical needles. Preferred needle materials are alloys of stainless steel such as 300 and 400 series stainless steels.

The alloy is originally in the form of wire stock which is straightened (if necessary) and cut into needle blanks by processes and machinery familiar to those with skill in the art. The needle blanks typically have a diameter of from about 1.5 mils for ophthalmic needles to about 62 mils for sternum needles. A mil is one thousandth of an inch, i.e. 0.001 inches. The needle blanks may be drilled at one end, either mechanically or by laser drilling, to form an axially aligned hole therein for the reception of a surgical suture. Alternatively, the needle blanks may be channeled for suture attachment. Drilling or channeling may be performed before or after tumbling the needle blanks in accordance with the present disclosure.

Preferred are needles made from 455 stainless steel with diameters of from about 24 mils or less to about 60 mils. The needles are tapered to a finished or semi-finished point and may optionally be curved before or after tumbling.

To produce a radius on the tip of the needle the needle is tumbled in a hard medium, as explained below. The needle may be finished, i.e. already ground, and polished to a sharp point before the needle is tumbled Optionally, the point of the tapered tip may be cut off to produce a wider diameter blunt tip prior to tumbling. As yet a further alternative, the starting needle may be partially finished. By way of example, tapered needles typically are formed by subjecting the needle to a number of grinding passes, so it is contemplated that the initial taper could be formed by subjecting the needle to some but not all of the passes required to completely form the tip. Optionally, an abrasive medium may initially be used to blunt the needle tip. However, abrasive media scratch the needle surface and should be followed by tumbling with a hard medium as described below. The radiused needles may further be tumbled in a soft medium for polishing.

The particles of tumbling medium preferably should not cause excessive scratching of the needle surface. That is, the media should not reduce surface clarity in an objectionable manner. To accomplish this the tumbling medium must either have a hardness less than or equal to that of the needle blank (i.e. a "soft" medium), or the particles of tumbling medium must have a smooth surface, i.e. no sharp points or edges capable of causing a visible scratch. As distinguished from abrasive media, the preferred medium for creating a radiused tip operates by burnishing the needle rather than by abrasion and scratching. A suitable "hard" medium (i.e. one having a hardness greater than that of the needle blanks) comprises particles having no curved surface feature with a radius of a size less than the diameter of the needle blank, which might be capable of producing a visible scratch The media may be substantially spherical. However, nonspherical media, e.g. stainless steel tapered pins, may also be employed. The medium is generally smooth. If the media is. rough, it should be softer than the blanks.

The particles of hard media are preferably spherical and have a diameter of from about 0.5 millimeters (mm) to about 10 mm, preferably about 2 mm to about 7 mm and a glassy smooth surface. The diameter varies with the size of the needle blank. For large (18–30 mil) wire diameters a spherical particle diameter of about 4 to about 8 mm is preferred. For small (down to 10 mil) wire diameters a spherical particle diameter of about 1 to about 3 mm is preferable. Hard media suitable for tumbling in the present invention include, for example, ceramic, porcelain, stainless steel and glass. Metallic media is generally used for larger needles in the 24 mil to 60 mil needle size range. Such metallic media could bend relatively smaller needles. Because of the extreme weight differences of standard metallic media relative to needles, glass or porcelain media is preferred. Porcelain is most preferred because it is generally more durable than glass. When abrasive media, such as rough surfaced aluminum oxide are employed for abrasive radiusing, it is advantageous to follow with a second tumbling operation using the aforementioned hard media for burnishing, and optionally a third tumbling operation using a substantially dry soft medium (which may include minor amounts of lubricating oils, etc.) such as described below for final polishing.

A typical small ceramic media is Daistone DP-1 two (2) mm media made by Nippon Dia Industry Co., Ltd., 7-26, 3-Chome, Nishi-shinjuku, Shinjuku-ku, Tokyo, Japan. A typical large ceramic media is VF-P, six (6) mm media made by Vibra Finish Co., 8491 Seward Road, Hamilton, Ohio 45011.

Tumbling to cause radiusing preferably is performed in a wet fashion. Low liquid, e.g. water, levels are harsher than high liquid levels and may shorten processing time. In wet tumbling, an acidic or basic agent is present with the media during tumbling. A typical alkaline mixture is Oakite™ FM403 made by Oalite Products, Inc., 50 Valley Road, Berkeley Heights, N.J. 07922. Such a mixture gives lubricity and helps clean parts. An acidic or alkaline mixture may be used during tumbling of 300-type stainless steels. However, preferably an alkaline mixture is used during tumbling of 400-type stainless steels. Typically about 25 to about 75 ml. of Oakite™ (FM-403) is added per 2.5 liter barrel with the remainder being hot tap water. Also, the tumbling media and needle blanks are typically in about 0.5–2:0.5–2 volume ratio. Wet tumbling may also be performed with Dreher C-168 powder jar A-13 liquid 50 cc/2.5 liter BBL along with porcelain balls to remove discolorations on wire surface.

Wet tumbling media may also have silica or lime added to it. The particle size of silica or lime is small, preferably about that of talc. Most industrial talcs have one of three general sizes: 98% minus 200-mesh screen, 98.5% minus 325-mesh screen; and 99.5% minus 325-mesh screen. Perry's Chemical Engineer's Handbook, p. 8–51, 6th Ed. McGraw-Hill (1984). Extremely fine talcs have a particle size of 5 microns and a specific area of 30 $m^2$/gm. Id.

Particles of soft, substantially dry media are optionally used for a fmal polishing step and can be of any shape suitable for tumbling. Thus, the media does not have to be spherical, e.g., wood pegs, triangles, or squares are suitable. Preferably the soft medium is formed into spherical particles. Because the soft medium is not harder than the needle blanks it will not cause scratching thereof. Examples of soft media include wood beads, ground corncob, and ground walnut shells, e.g. Dreher NPG8 or NPG 1500. Powders of silica or lime are generally added to the soft media to facilitate deburring. Tumbling with soft media is usually performed in a substantially dry fashion. Liquid abrasives such as Dreher SFF may be added. Typically about 10 ml to about 50 ml of liquid abrasive are added per 2.5 liter barrel. Alternatively, 1–5 tsp./2.5 liter BBL of dry abrasives such as Dreher TPP may be added.

Centrifugal, rotary or vibratory tumbling may be employed. During centrifugal tumbling, the tumbler may be rotated about a horizontal axis. Alternatively the tumbler can agitate the needle blanks and media by means of rotation around a vertical axis. Some centrifugal tumblers contain drums with multiple chambers. Such a tumbler may create up to 25 gravities of force in its chambers. The typical duration of centrifugal tumbling ranges from ten (10) minutes to one (1) hour. Additional background on centrifugal tumbling is provided by Dreher et al., Precision Sliding Grinding in Centrifugal Equipment, Industrial and Production Eng., Vol 2 (1985), incorporated by reference. An example of a centrifugal tumbler is made by Dreher Corp., 57 George Leven Drive, Attleboro, Mass. 02703. This address is that of Dreher's U.S. Distributor. The parent of Dreher Corp. is a German company.

Centrifugal tumbling is faster than vibratory tumbling. However, vibratory tumbling is gentler. A typical vibratory tumbler is made by Ray Tech., P.O. Box 6, Route 32, Stafford Industrial Park, Stafford Springs, Conn. 06076 under the designations TUMBLE-VIBE and ADJUSTA-VIBE.

EXAMPLE 1

Control samples of blunt tip needles were obtained from B. G. Sulzle, Inc. of Syracuse, N.Y. The control sample group were curved blunt tip needles with a tapered point (type BT-11). These needles were fabricated from 420F stainless steel by grinding, machining and polishing. The needle diameter was 0.044 inches.

EXAMPLE 2

A quantity of finished tapered Sulzle needles with sharp points (Type GS) with 0.044 inch diameter were provided. These needles were placed in a vibratory tumbler with angle cut cylinders of aluminum oxide as an abrasive tumbling medium and tumbled for about 280 hours.

Next, to accomplish burnishing, the needles were placed in a centrifugal tumbler and tumbled for about 30 minutes with porcelain balls as the tumbling medium. The porcelain balls had a diameter of 3 to 6 millimeters and had a glassy smooth surface.

Finally, the needles were tumbled for 30 minutes in a centrifugal tumbler with dry walnut shells as the polishing medium.

The resulting polished needles had a spherical (hemispherical) tip radius of 0.0068 inches (0.0136 inch diameter). Upon inspection under magnification the resulting polished needles of this Example appeared to be equivalent in shape and surface characteristics to the control sample of Sulzle blunt tip needles.

EXAMPLE 3

A quantity of finished tapered Sulze needles with sharp points (type T-11 with 0.044 inch diameter, as provided in Example 2) were provided. These needles were modified by grinding the point to produce a flat tip of about 0.026 inch diameter on the needle. These needles were then placed in a vibratory tumbler with angle cut cylinders of aluminum oxide as an abrasive tumbling medium and tumbled for about 280 hours.

Next, to accomplish burnishing, the needles were placed in a centrifugal tumbler and tumbled for about 30 minutes with porcelain balls as the tumbling medium.

Finally, the needles were tumbled for 30 minutes in a centrifugal tumbler with dry walnut shells as the polishing medium The porcelain balls had a diameter of 3 to 6 millimeters and had a glassy smooth surface.

The resulting polished needles had a spherical (hemispherical) tip radius of about 0.0129 inches (0.0258 inch diameter). Upon inspection under magnification, the resulting polished needles of this Example appeared to be equivalent in shape and surface characteristics to the control sample of blunt tip Sulzle needle The foregoing Examples demonstrate that the tumbling method of blunting surgical needles is at least as effective in producing blunt tip needles from finished needles as the conventional method of grinding. Advantageously, the tumbling method is less expensive and can process large quantities of needles in batch processes with lower skill and labor requirements than conventional methods.

It will be understood that various modifications may be made to the embodiments and examples disclosed herein. For example, it will be appreciated that relatively short tumbling times may be achieved using an abrasive medium in a centrifugal tumbler, as opposed to a vibratory tumbler. Similarly, it is contemplated that radiusing of the needle tip may be achieved using only a burnishing tumbling operation using a hard medium, without any abrasive tumbling. Therefore, the above description should not be construed as limiting, but merely as exemplifications of preferred embodiment Those skilled in the art will envision other modifications within the scope and spirit of the claims appended hereto.

What is claimed is:

1. A method for producing blunt tip surgical needles, comprising:

a) providing surgical needle with a sharp pointed tip;

b) forming a substantially hemispherical radius on the tip of said surgical needle by a first tumbling operation in a tumbler with an abrasive first medium for a first duration of tumbling time; and c) burnishing the surgical needle by a second tumbling operation in a tumbler with a second medium for a second duration of tumbling time, wherein the second medium comprises particles having a hardness greater than that of the needles and having no surface feature with a radius less than the diameter of the needle.

2. The method of claim 1 wherein the surgical needle is curved.

3. The method of claim 1 wherein said second medium comprises particles having a hardness greater than that of the needles and having no surface feature with a radius less than the diameter of the needle.

4. The method of claim 1 comprising the additional step of:

d) polishing the surgical needle by a third tumbling operation in a tumbler with a third medium for a third duration of tumbling time.

5. The method of claim 4 wherein said third medium is selected from the group consisting of dry walnut shells, wood and corncob.

6. The method of claim 1 wherein said surgical needle is fabricated from a material selected from the group consisting of 300 and 400 series stainless steel.

7. The method of claim 1 wherein said needle possesses a diameter of from about 0.0015 inches to about 0.062 inches.

8. The method of claim 1 wherein said radiusing step is performed in a vibratory tumbler.

9. The method of claim 1 wherein said radiusing step is performed in a centrifugal tumbler.

10. The method of claim 1 wherein said first medium comprises angle cut cylinders of aluminum oxide.

11. The method of claim 1 wherein said second medium is selected from the group consisting of porcelain, ceramic, stainless steel and glass.

12. The method of claim 11 wherein said second medium comprises spherical particles.

13. The method of claim 1 wherein said first medium includes a liquid.

14. The method of claim 13 wherein said first medium is acidic.

15. The method of claim 13 wherein said first medium is alkaline.

16. The method of claim 1 wherein said first medium is selected from the group consisting of porcelain, ceramic, stainless steel and glass.

17. The method of claim 16 wherein said first medium comprises spherical particles.

18. The method of claim 1 wherein the needle has a diameter of about 0.044 inches and the hemispherical radius formed on the tip of the needle is about 0.0068 inches.

19. The method of claim 1 wherein the needle has a diameter of about 0.044 inches and the hemispherical radius formed on the tip of the needle is about 0.0129 inches.

20. A method of producing blunt surgical needles having a radiused tip, comprising:

a) providing an at least partially finished curved surgical needle with a sharply pointed tip;

b) tumbling the surgical needle in a first tumbling operation in a tumbler with an abrasive medium for as first duration of time;

c) tumbling the surgical needle by a second tumbling operation in a tumbler with a burnishing medium for a second duration of tumbling time, the first and second tumbling operations producing a radiused tip on the surgical needle, wherein said burnishing medium comprises particles of from about 0.5 mm to about 10 mm.

21. The method of claim 20 wherein said burnishing medium comprises particles having a hardness greater than that of the surgical needle and having no surface feature with a radius less than the diameter of the needle.

22. The method of claim 20 comprising the additional step of:

d) tumbling the surgical needle in a third tumbling operation in a tumbler with a polishing medium for a third duration of tumbling time.

23. The method of claim 22 wherein said polishing medium is selected from the group consisting of dry walnut shells, wood and corncob.

24. The method of claim 20 wherein said abrasive medium comprises angle cut cylinders of aluminum oxide.

25. The method of claim 20 wherein said burnishing medium is selected from the group consisting of porcelain, ceramic, stainless steel and glass.

26. The method of claim 25 wherein said burnishing medium comprises spherical particles.

* * * * *